US009404285B2

(12) United States Patent
Lahiji et al.

(10) Patent No.: US 9,404,285 B2
(45) Date of Patent: Aug. 2, 2016

(54) CYLINDER GUARD FOR DEADBOLT LOCK

(71) Applicant: SPECTRUM BRANDS, INC., Middleton, WI (US)

(72) Inventors: Behrang F. Lahiji, Mission Viejo, CA (US); Jeffrey Dean Pearson, Sherman, TX (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 14/929,663

(22) Filed: Nov. 2, 2015

(65) Prior Publication Data

US 2016/0053512 A1 Feb. 25, 2016

Related U.S. Application Data

(63) Continuation of application No. 14/091,383, filed on Nov. 27, 2013, now Pat. No. 9,175,500.

(60) Provisional application No. 61/731,145, filed on Nov. 29, 2012.

(51) Int. Cl.

| | |
|---|---|
| ***E05B 15/00*** | (2006.01) |
| ***E05B 17/20*** | (2006.01) |
| ***B21D 22/20*** | (2006.01) |
| ***E05B 15/02*** | (2006.01) |

(52) U.S. Cl.

CPC ..... *E05B 17/2084* (2013.01); *B21D 22/20* (2013.01); *E05B 15/00* (2013.01); *E05B 15/02* (2013.01); *E05B 2017/2096* (2013.01); *Y10T 70/7921* (2015.04)

(58) Field of Classification Search

CPC ..... E05B 9/08; E05B 9/084; E05B 9/02; E05B 15/02; E05B 15/1614; E05B 67/04; E05B 67/38; E05B 65/06; E05B 15/00; E05B 17/2084; B21D 22/20; Y10T 70/7921

USPC ..... 70/417, 134, 370–373, 381, 447–449, 70/451, 452, DIG. 60, DIG. 61

See application file for complete search history.

(56) References Cited

U.S. PATENT DOCUMENTS 2,481,015 A * 9/1949 Ingersoll ..... B65D 7/045 220/634
3,010,172 A * 11/1961 Kaplan ..... F16L 23/10 24/279

(Continued)

*Primary Examiner* — Suzanne Barrett
(74) *Attorney, Agent, or Firm* — Barnes & Thornburg LLP

(57) ABSTRACT

A cylinder guard for a deadbolt lock having a face portion and an inner portion. The inner portion includes a radial flange and an axial flange created by forming the wall of the guard into a doubled portion. Indentations are formed in the axial flange which enhances the resistance of the guard to an attack upon the deadbolt. The guard also includes a tapered blow-deflecting portion between the inner portion and face portion. A crush zone may be formed between the inner and face portions to attenuate the energy from an attack that is transferred to the axial and radial flanges. A method for making the guard includes stamping a body from steel strip using a multi-station press.

17 Claims, 16 Drawing Sheets

(56) References Cited

U.S. PATENT DOCUMENTS 3,514,983 A * 6/1970 Krook ..... E05B 9/084 292/337
4,338,804 A * 7/1982 Solovieff ..... E05B 15/1614 292/337
5,216,910 A * 6/1993 Lin ..... E05B 15/1614 70/370
5,335,525 A * 8/1994 Solovieff ..... E05B 63/0056 70/370
5,722,273 A * 3/1998 Lin ..... E05B 17/0058 292/147
6,230,528 B1 * 5/2001 Don ..... E05B 15/02 70/224
6,840,070 B1 * 1/2005 Huang ..... E05B 3/06 292/348
7,596,975 B1 * 10/2009 Yuan ..... E05B 9/08 70/134
7,900,489 B2 * 3/2011 Roth ..... E05B 9/084 70/134
9,175,500 B2 * 11/2015 Lahiji ..... E05B 15/02

* cited by examiner

CYLINDER GUARD FOR DEADBOLT LOCK

RELATED APPLICATIONS

The present application is a continuation of U.S. application Ser. No. 14/091,383, filed on Nov. 27, 2013, entitled "Cylinder Guard for Deadbolt Lock" which claimed the benefit of U.S. Provisional Patent Application Ser. No. 61/731,145, filed Nov. 29, 2012, entitled "Cylinder Guard for Deadbolt Lock." These applications are hereby expressly incorporated by reference in their entirety into the present application.

TECHNICAL FIELD

The present invention relates generally to deadbolt locks and particularly to deadbolts that are resistant to attack. More particularly, the present invention relates to a cylinder guard for a deadbolt lock.

BACKGROUND

One way in which would-be intruders attempt to gain access to a locked structure is by direct attack against a deadbolt lock. For example, they may apply repetitive downward blows against the deadbolt cylinder guard or escutcheon, using a vertical impactor. Depending upon the lock grade, fewer or greater blows in the neighborhood of 75 ft-lbf may be used to breach the lock. This occurs when the upper portion of the guard or escutcheon is indented enough to pull the upper portion away from the door to such an extent that the intruder can manipulate any exposed lock mechanism by hand or with a screwdriver, while manually attempting to withdraw the bolt from the strike by end pressure. Existing protection systems include the use of various die-cast zinc guard or multi-piece steel guards. However, they entail considerable costs to manufacture and may not provide the most robust of security.

SUMMARY

According to one aspect, the invention provides a guard pressed out of a single piece of steel. This yields significant cost savings. In addition, the guard includes stiffeners that strengthen the regions of the guard which are normally most vulnerable, namely the interface of the guard with the door. Also, the guard of the present invention may include a crush zone to attenuate the amount of energy of an attack that reaches this interface.

According to some embodiments, the cylinder guard includes a one-piece member defining a generally cylindrical wall having a predetermined thickness and a longitudinal axis and having a face portion and an inner portion. The face portion defines an annular lip, and the inner portion defines a doubled portion at a first terminus thereof. The doubled portion further defines a radial flange extending radially outwardly, an axial flange, and an end surface at the first terminus.

According to a further aspect, the invention provides a cylinder guard for a deadbolt lock having stiffeners formed on an end surface thereof. The stiffeners may include a plurality of indentations equally spaced about the end surface. The stiffeners can be defined by radially-extending or circumferentially-extending indentations.

In some embodiments, the cylinder guard has a crush zone intermediate the face and inner portions thereof for attenuating the energy from an attack that is transferred to the axial and radial flanges formed on the rear portion.

In another aspect, depending on the circumstances, the invention provides a cylinder guard for a deadbolt lock having a blow-deflecting portion in a crush zone intermediate the face and inner portions thereof.

In a still further aspect, the invention provides a method of making a cylinder guard for a deadbolt lock including the steps of stamping a generally cylindrical body having a longitudinal axis from a single piece of steel having a predetermined thickness, forming a flange extending radially outwardly from one end of the body, and forming a double-wall portion between the one end and the flange.

Additional features and advantages of the invention will become apparent to those skilled in the art upon consideration of the following detailed description of the illustrated embodiment exemplifying the best mode of carrying out the invention as presently perceived.

BRIEF DESCRIPTION OF THE DRAWINGS

The present disclosure will be described hereafter with reference to the attached drawings which are given as non-limiting examples only, in which.

Corresponding reference characters indicate corresponding parts throughout the several views. The exemplification set out herein illustrates embodiments of the invention, and such exemplification is not to be construed as limiting the scope of the invention in any manner.

DETAILED DESCRIPTION OF THE DRAWINGS

Figure 1:
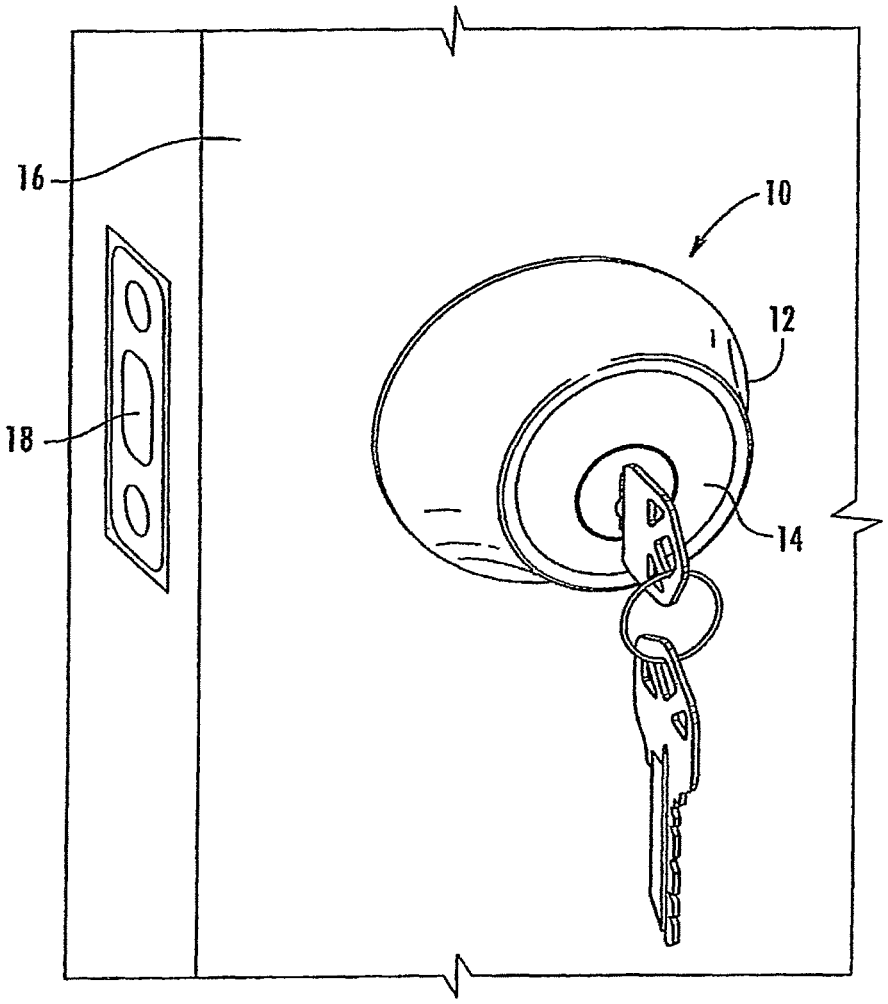
FIG. 1 is a perspective view of a deadbolt lock containing a cylinder guard according to an embodiment of the present invention.

As shown in FIG. 1, a deadbolt lock 10 includes a brass cover 12, a cylinder 14, and is mounted on a door 16 so that a lock bolt 18 is positioned to lock the door.

Figure 3:
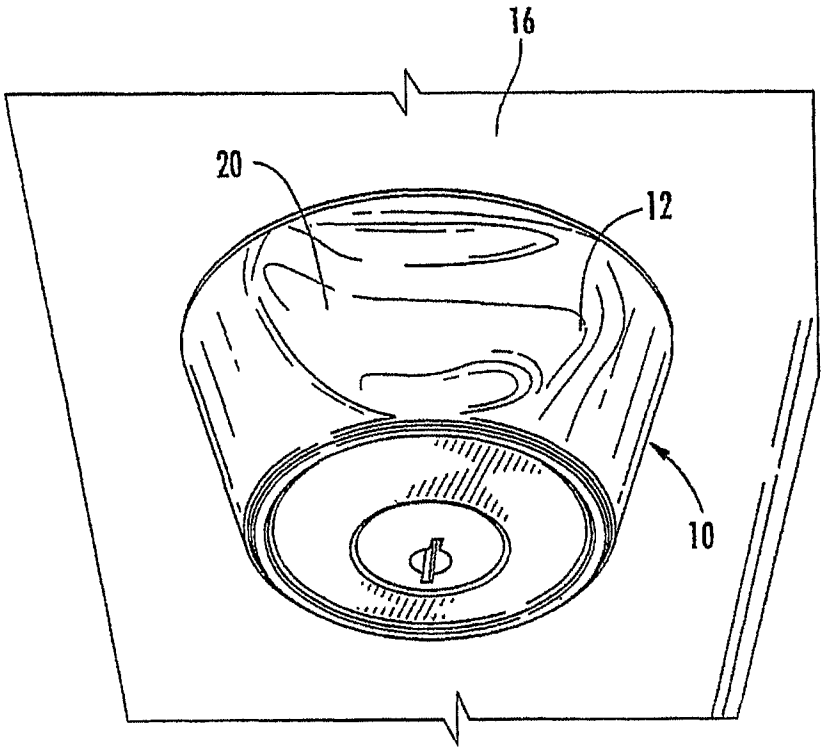
FIG. 3 is a perspective view of a deadbolt lock containing a cylinder guard according to an embodiment of the present invention after undergoing a typical attack.
Figure 2:
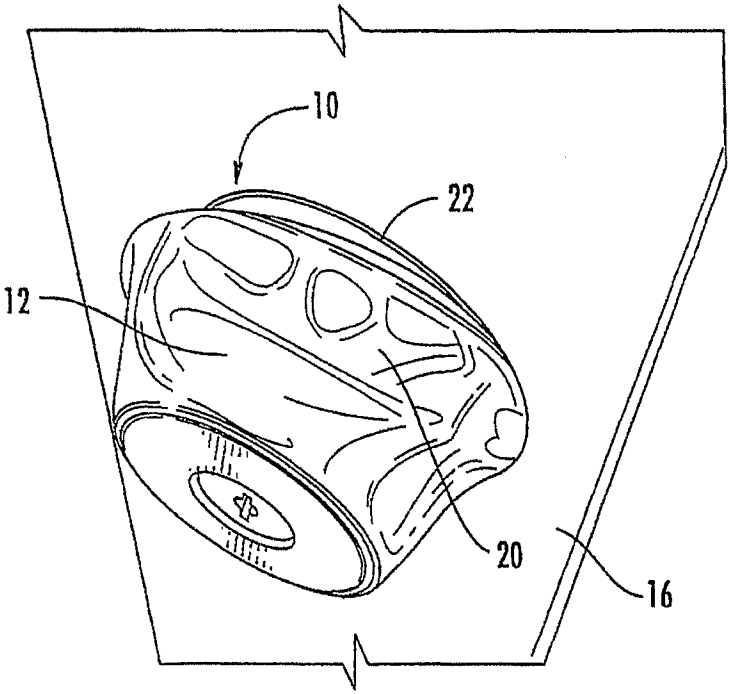
FIG. 2 is a perspective view of a deadbolt lock not containing a cylinder guard according to an embodiment the present invention after undergoing a typical attack.

The results of a typical attack on the lock 10 not having a cylinder guard according to the present invention are shown in FIG. 2. Downwardly-directed blows by an impactor against the deadbolt lock 10 have produced a dent 20 in the cover 12, thereby creating a gap 22 between the rear of the deadbolt lock and the door 16. This gap 22 now permits an intruder to gain access to the lock mechanism (not shown), thereby breaching the lock's security. Including a cylinder guard of the present invention, however, enables the deadbolt lock 10 to withstand the attack. FIG. 3 shows that the downwardly-directed blows have produced a dent 20, but have failed to separate the rear of the deadbolt lock 10 from the door 16, thereby preserving the lock's security.

Figure 4:
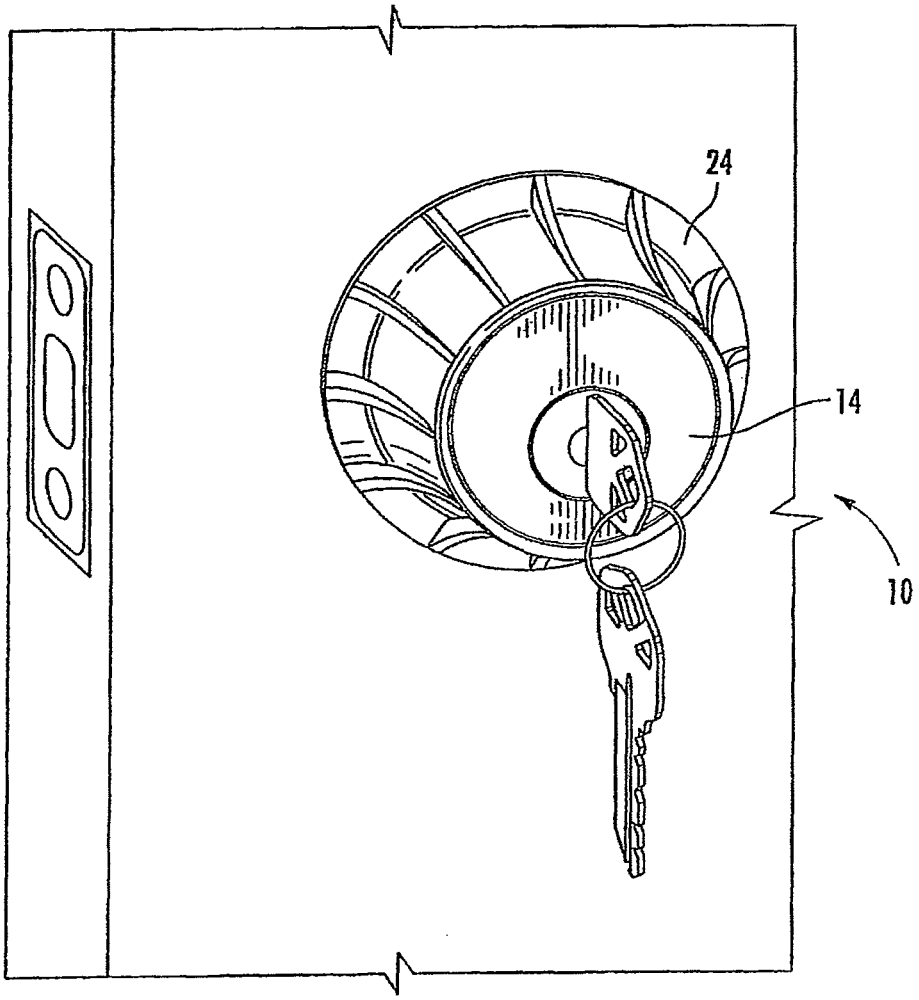
FIG. 4 PRIOR ART
FIG. 4 is a perspective view of a deadbolt lock with the cover removed and showing a conventional die-cast zinc cylinder guard.
Figure 5B:
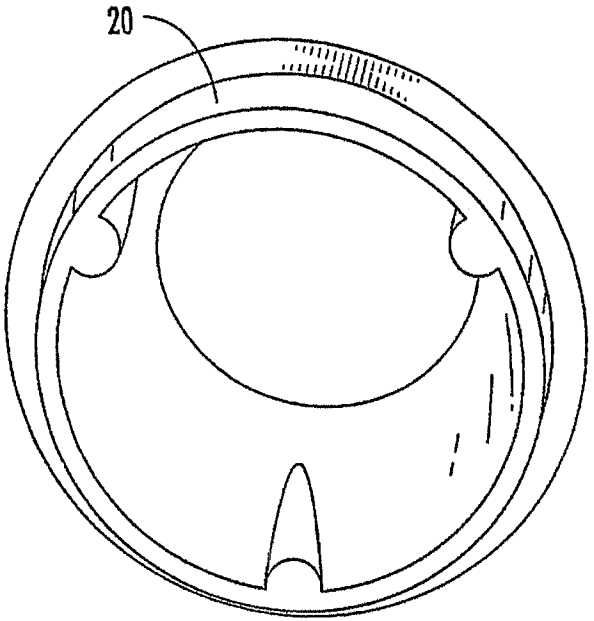
FIG. 5B PRIOR ART
FIGS. 5A and 5B are front and rear perspective detail views, respectively, of the die-cast zinc cylinder guard of FIG. 4.
Figure 5A:
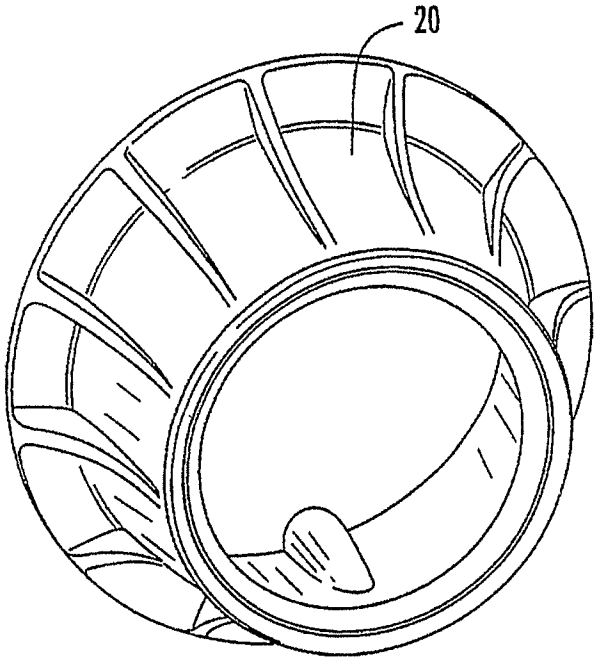
FIG. 5A PRIOR ART

FIG. 4 illustrates a deadbolt lock 10, with the cover 12 removed to reveal a conventional die-cast zinc cylinder guard 24. Details of the zinc cylinder guard 24 are shown in FIGS. 5A and 5B.

Figure 6B:
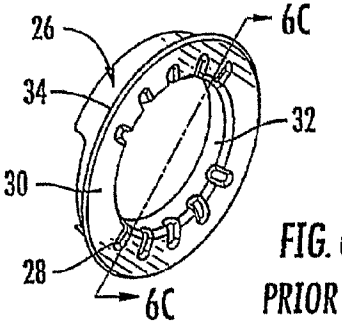
FIG. 6B PRIOR ART
FIG. 6B is a perspective detail view of the adapter of FIG. 6A.
Figure 6C:
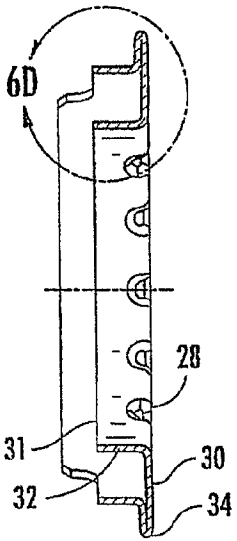
FIG. 6C PRIOR ART
FIG. 6C is a cross-sectional view of the adaptor of FIG. 6B taken along line 6C-6C.
Figure 6A:
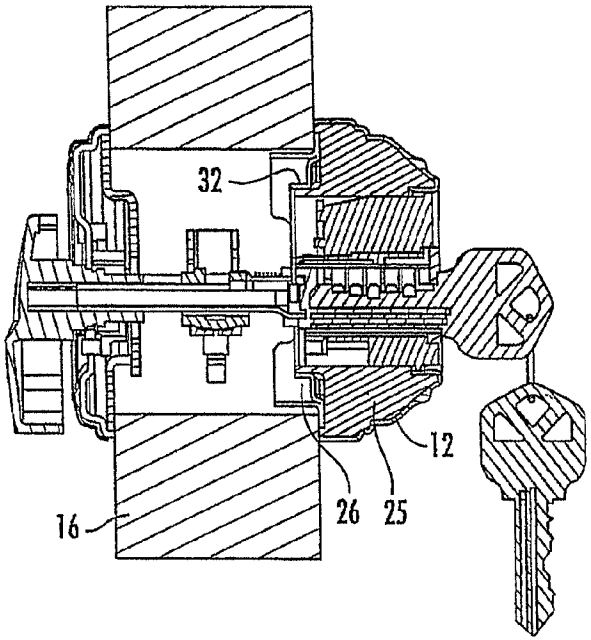
FIG. 6A PRIOR ART
FIG. 6A is a cross-section, taken from the side, of a deadbolt lock sub-assembly including yet another conventional die-case zinc cylinder guard, augmented by an adapter.
Figure 6D:
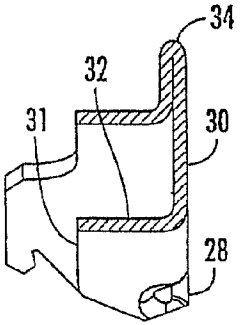
FIG. 6D PRIOR ART
FIG. 6D is an enlarged sectional detail view of the adapter of FIG. 6B taken at the area circled in FIG. 6C.

Another conventional zinc die-cast cylinder guard 25 is shown in FIG. 6A. An adapter 26 is disposed between the zinc guard 25 and the door 16, and is required to support the zinc guard against attack. As shown in FIGS. 6B, 6C and 6D, adapter 26 includes indentations 28 formed on adapter flange 30 axially inwardly from an inner end 31 of inner channel 32 and radially-inwardly of an outer rim 34 of adapter flange 30. The indentations 28 are designed to strengthen the inner channel 32.

Figure 7A:
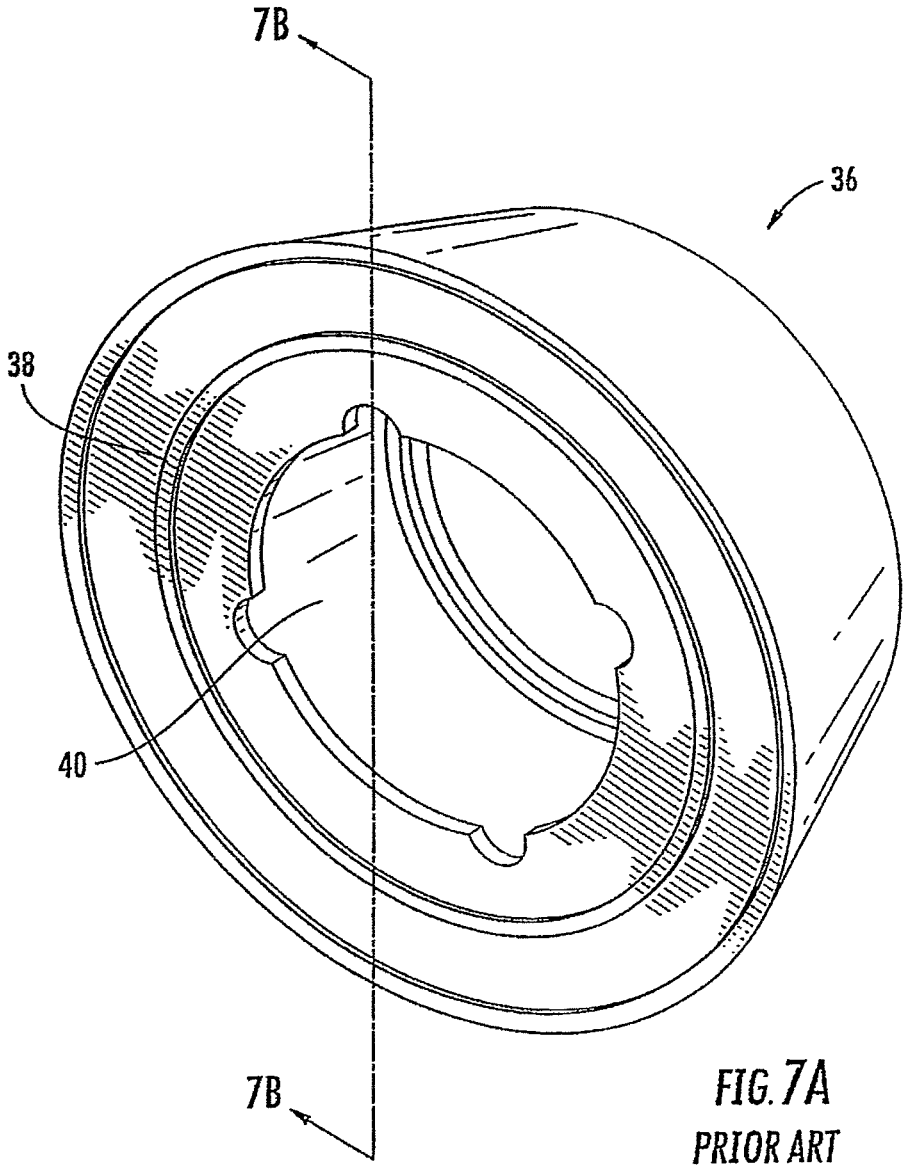
FIG. 7A PRIOR ART
FIG. 7A is a perspective view of a conventional multi-piece steel cylinder guard subassembly.
Figure 7B:
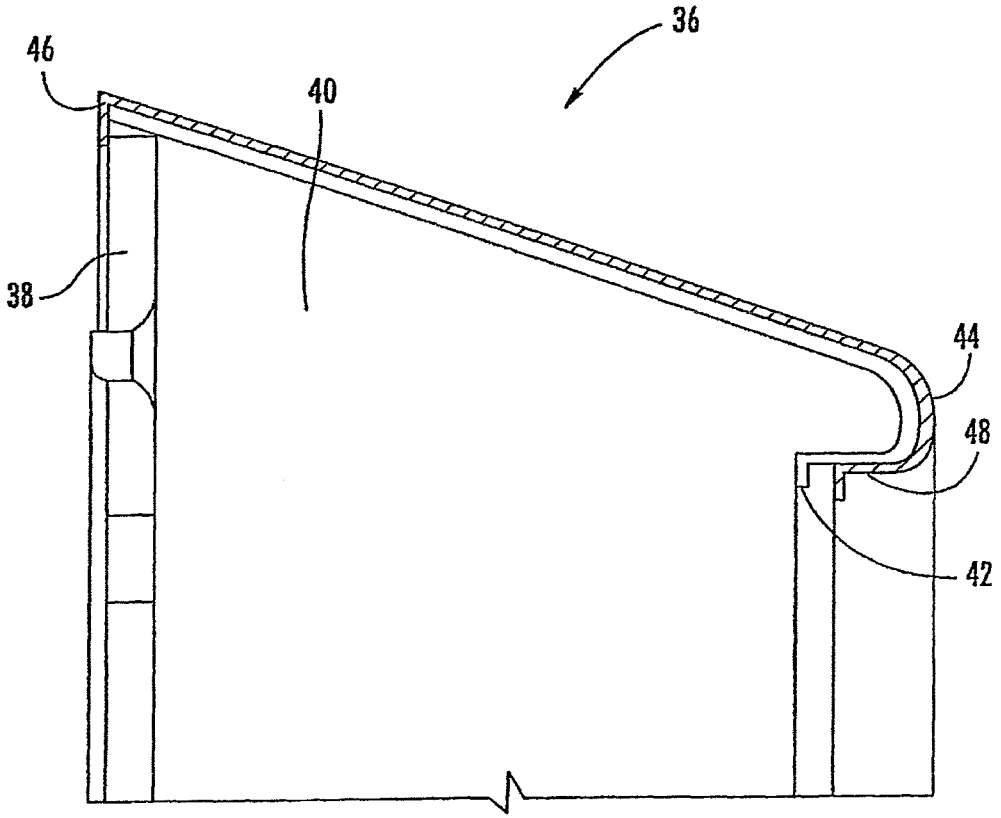
FIG. 7B PRIOR ART
FIG. 7B is a cross-sectional detail view taken along line 7B-7B of FIG. 7A.
Figure 8:
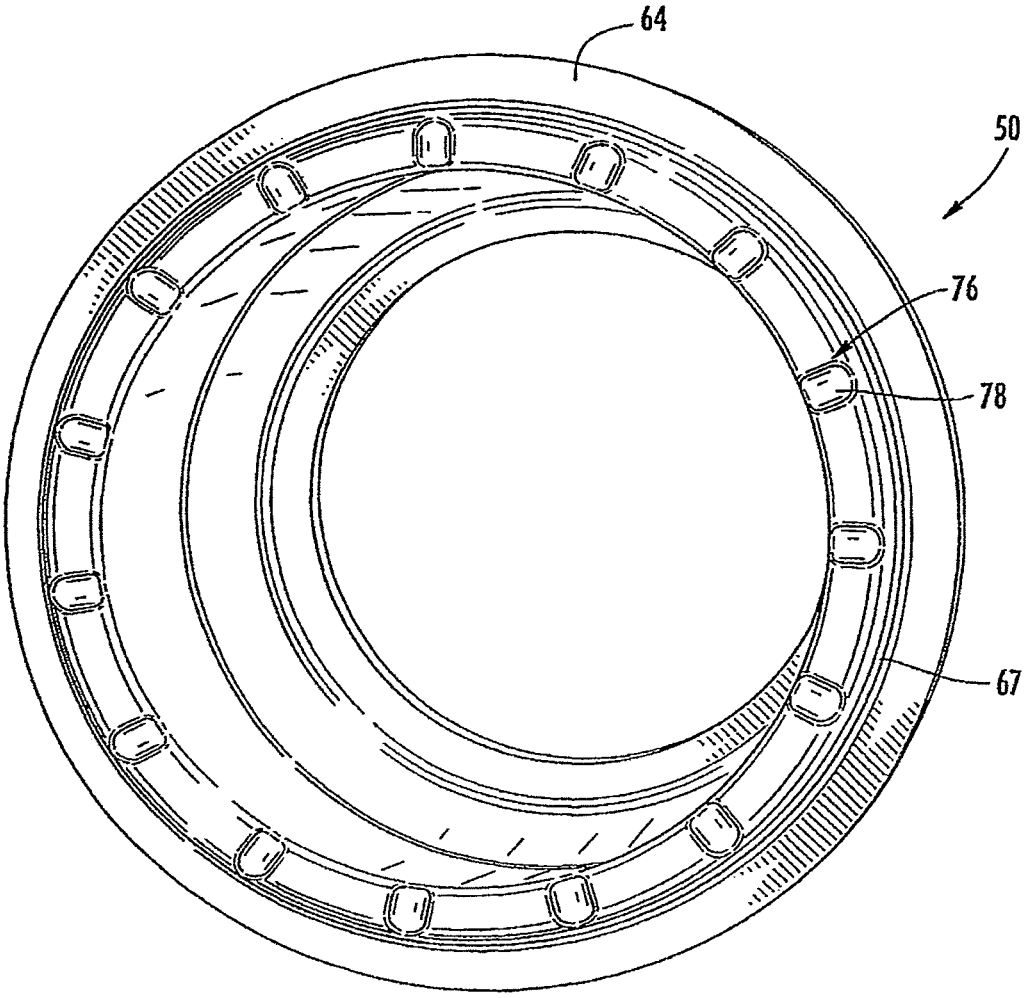
FIG. 8 is a perspective view taken from one end of one embodiment of a cylinder guard of the present invention.

A conventional two-piece steel guard subassembly 36 is illustrated in FIGS. 7A and 7B. Two-piece steel guard assembly 36 includes a steel back plate 38 and a steel guard member 40. Guard member 40 includes a radially-inward lip portion 42. A thin cover 44 holds the back plate 38 against the guard member 40. For that purpose, cover 44 includes a back lip 46 and a cover lip portion 48 engaging the back plate 38 and lip portion 42 respectively, as can be seen in FIG. 7B. This subassembly yields a cylinder guard which is less robust at the typical region of attack.

Figure 13:
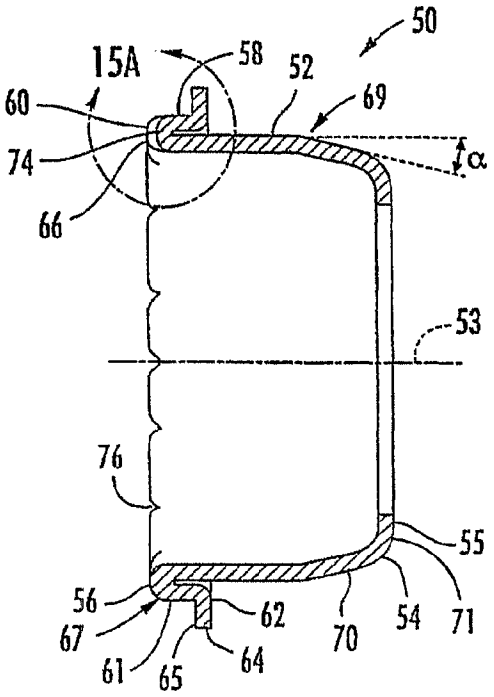
FIG. 13 is a cross-sectional view of the cylinder guard of the present invention taken along line 13-13 of FIG. 12.

One embodiment of a cylinder guard 50 of the present invention is shown in FIGS. 8, 11, 12, 13, 14, 15A, 15B and 16. With particular reference to FIG. 13, the guard 50 includes a generally cylindrical wall 52 defining a longitudial axis 53, a face portion 54 having a face end 55, and an inner portion 56. The inner portion 56 defines a doubled portion 58 disposed at a first terminus 60 of the inner portion 56 of the wall 52. The doubled portion 58 is created by the wall 52 bending axially away from the first terminus 60, thereby forming an outer wall 61, as shown in more detail in FIG. 15A. The outer wall 61 extends radially outwardly at a second terminus 62 to form a radial flange 64.

Figure 12:
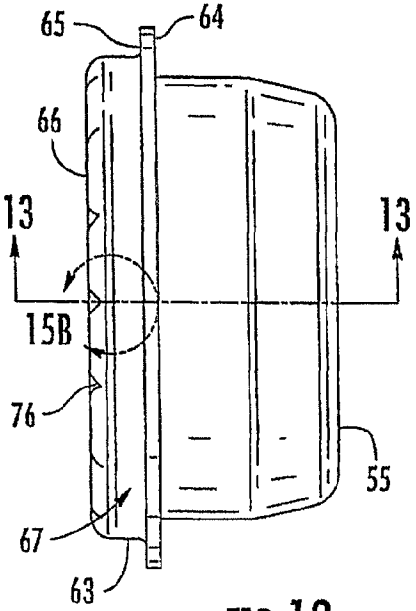
FIG. 12 is a side elevational view of the cylinder guard of FIG. 11.
Figure 15B:
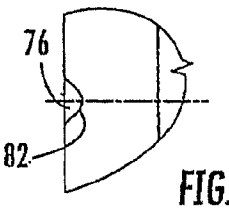
FIG. 15B is an enlarged detail view of the circled area of FIG. 12.
Figure 11:
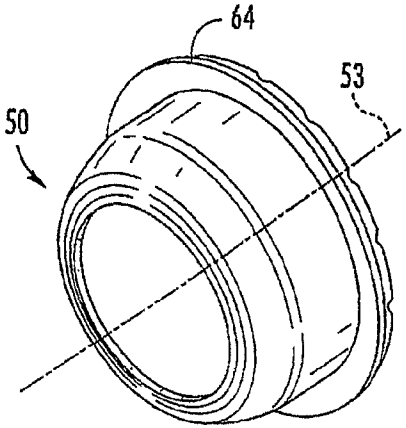
FIG. 11 is a perspective view of the cylinder guard of FIG. 8 taken from the other end.
Figure 15A:
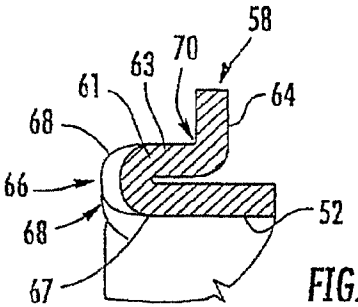
FIG. 15A is an enlarged sectional detail view of the circled area of FIG. 13.
Figure 14:
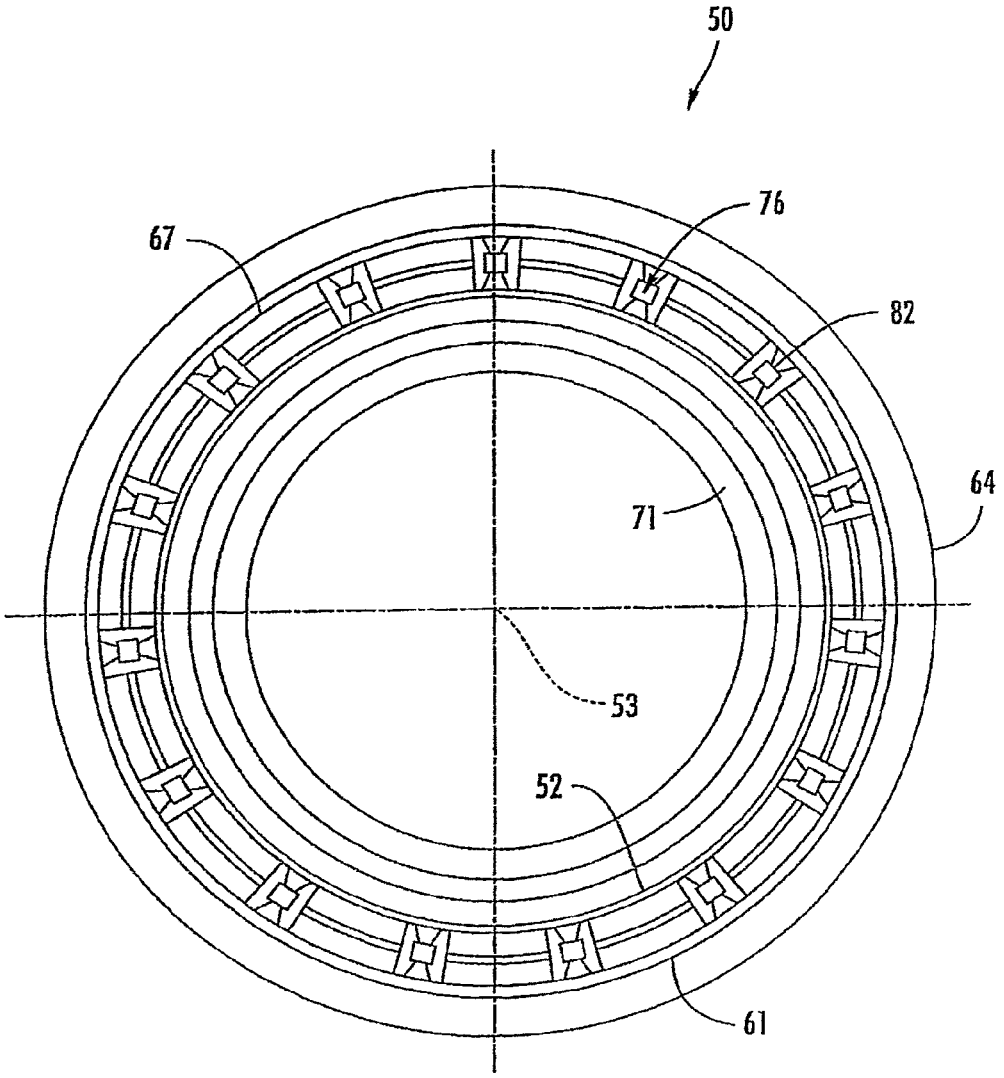
FIG. 14 is a left side elevational view of the cylinder guard of FIG. 12.
Figure 16:
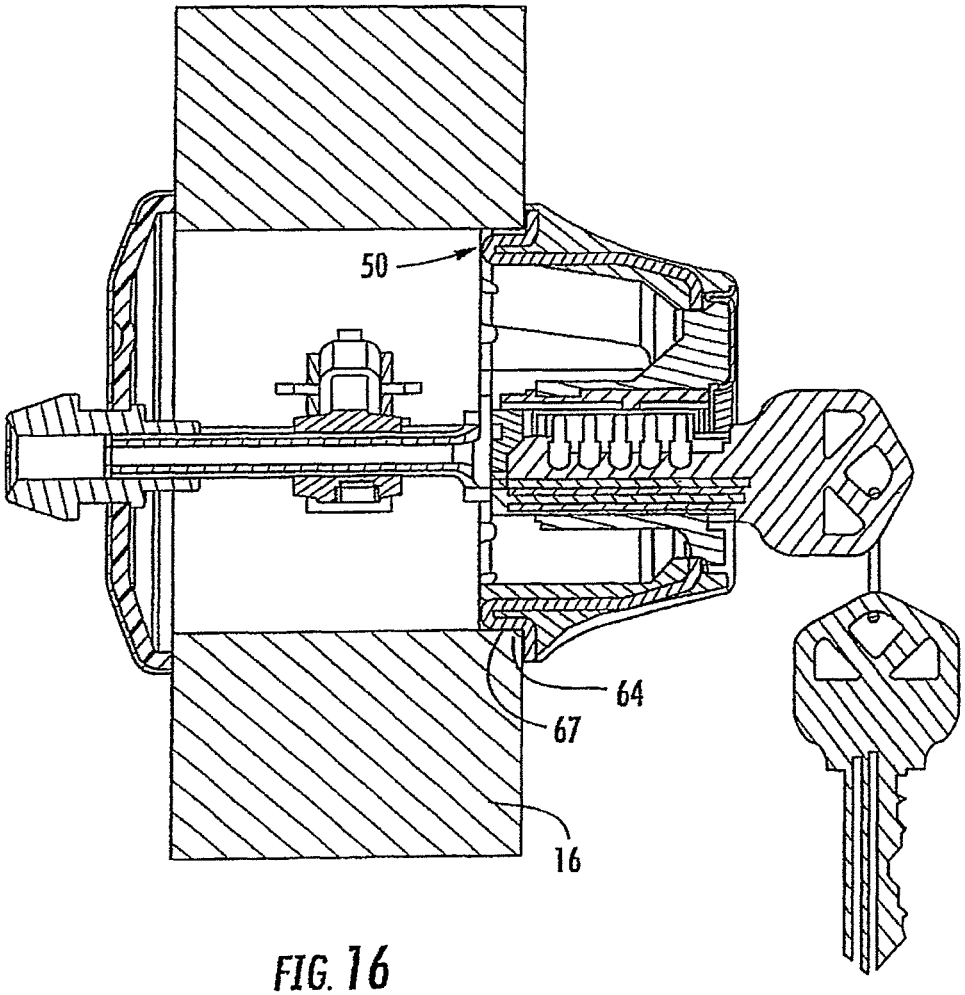
FIG. 16 is a cross sectional view taken from the side of a deadbolt lock containing a cylinder guard according to an embodiment of the present invention mounted on a door.

With continued reference to FIGS. 13 and 15A, and with additional reference to FIG. 12, the diameter of radial flange 64 is 2.371 inches and the diameter of the outer surface 63 generated by the outer wall 61 is 2.096 inches in some embodiments, while the distance between the innermost surface 65 of radial flange 64 to the face end 55 of the cylinder guard is 0.887 inch in some embodiments.

With further reference to FIG. 15A, the doubled portion 58 includes an inner face portion 66 defined by two arcuate portions 68. In some embodiments, the arcuate portions 68 have radii of 0.067 inches. The face portion 66, wall 52 and outer wall 61 of doubled portion 58 together define an axial flange 67.

Now referring to FIG. 13, the wall 52 also defines a crush zone 69 intermediate the face portion 54 and the inner portion 56 of the cylinder guard 50. The purpose of the crush zone 69 is to cause the face portion 54 to collapse under the blows of an attack, thereby attenuating the amount of energy that can be transferred to radial flange 64 and axial flange 67. In one embodiment of the cylinder guard 50, the crush zone 69 is created at least by using a very malleable steel, namely ASTM 1008 DS or DDS drawing steel or deep drawing steel. In another embodiment of the cylinder guard 50, the entire cylinder guard wall 52 is formed of a single piece of such steel, in the range of from 0.055 inches to 0.066 inches thick.

Still referring to FIG. 13, the crush zone 69 further includes a blow-deflecting portion 70 disposed intermediate the inner portion 56 and a radially inwardly-extending lip 71 disposed at the face end 55 of the cylinder guard 50. In one embodiment, the blow-deflecting portion 70 extends linearly axially towards the lip 71 and radially inwardly, essentially forming a conical portion having an outer surface at an angle $\alpha$ with the horizontal. The purpose of the blow-deflecting portion 70 is to cause, as much as possible, the blows from an attack to glance away from the inner portion 56 of the wall 52. In one embodiment, the angle $\alpha$ is 14°. However, it is believed that a gradually curvilinear convex surface for the blow-deflecting portion 70 should also work.

Figure 10:
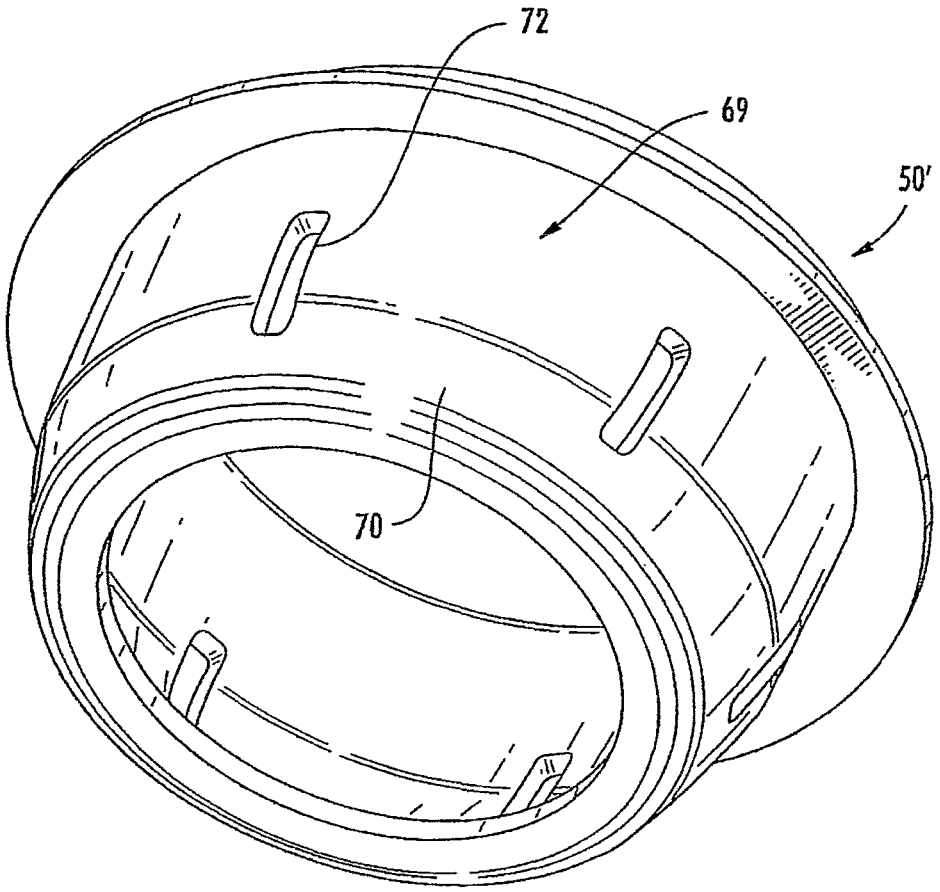
FIG. 10 is a perspective view taken from the other end of yet another embodiment of a cylinder guard of the present invention.

FIG. 10 illustrates another embodiment of the cylinder guard 50', in which an array of through-slots 72 is formed in the crush zone 69. In the embodiment shown, the through-slots are rectangular and are disposed at least partially in the blow-deflecting portion 70. In one illustrative embodiment, from 6 to 8 through-slots 72 are disposed circumferentially equidistance about the crush zone 69. For example, there could be 6 through-slots 72, each having a length of 0.4 inches and a width in the range of from 0.060 to 0.120 inches. In some cases, the through-slots 72 begin about midway in the blow-deflecting portion 70 and extend axially rearwardly. The purpose of the through-slots 72 is to enhance the blow-distorting effects or crushability of the crush zone 69.

Referring now to FIGS. 8, 11-14 and 15A and 15B, an embodiment of the cylinder guard 50 is shown that includes an array of stiffeners 76 disposed circumferentially equidistantly about the inner face portion 66 of the wall 52. The stiffeners 76, in the form of radial indentations 78, increase the surface area of the axial flange 67, thereby increasing the moment of inertia in the region of the inner portion 56 of wall 52, against which an attack would likely be directed (see FIGS. 2 and 3B, and FIG. 16) and more specifically, at the area of the axial flange 67. In some cases, the stiffeners 76 include from 15 to 26 radial indentations 78 having a base 82 defining an arcuate cross-section, as can more particularly be seen in FIGS. 13, 14, 15A and 15B. In some cases, the diameter of the arcuate cross-section 82 is 0.080 inches.

Figure 9:
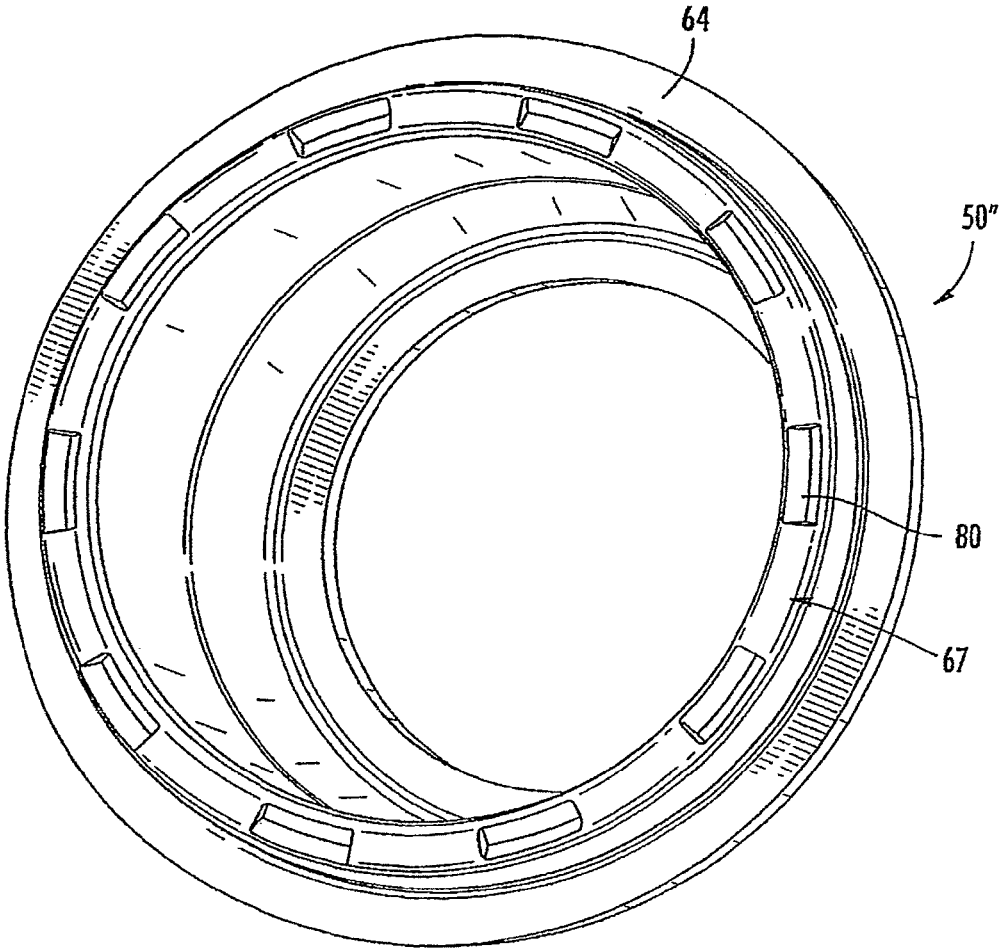
FIG. 9 is a perspective view taken from one end of another embodiment of a cylinder guard of the present invention.

Another embodiment of the cylinder guard is shown in FIG. 9, in which stiffeners 76 are defined by a plurality of equally-spaced circumferential indentations 80 formed in the axial flange 67. In this embodiment, the circumferential indentations 80 have generally triangular cross-sections.

Figure 17:
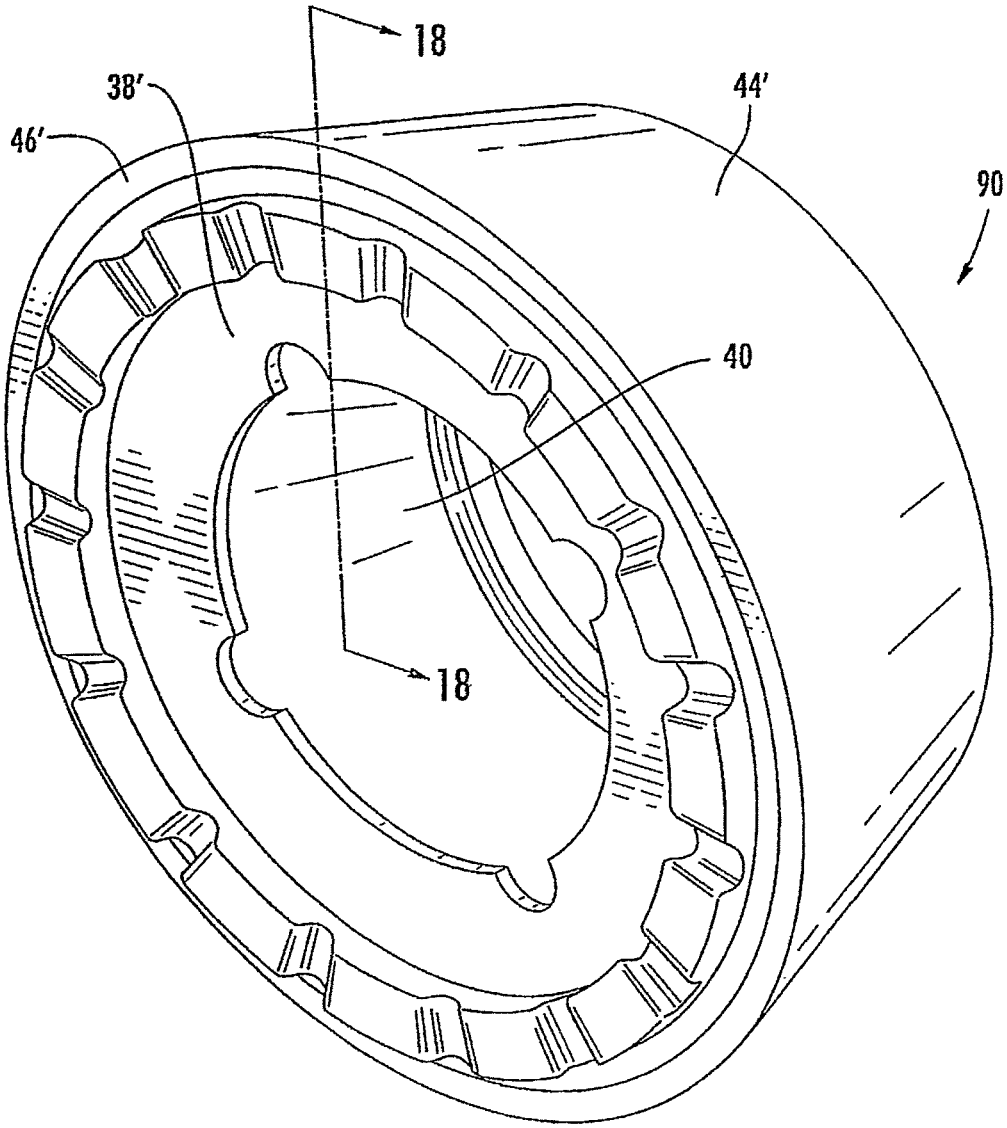
FIG. 17 is a perspective view of another embodiment of a cylinder guard for a deadbolt lock of the present invention.
Figure 18:
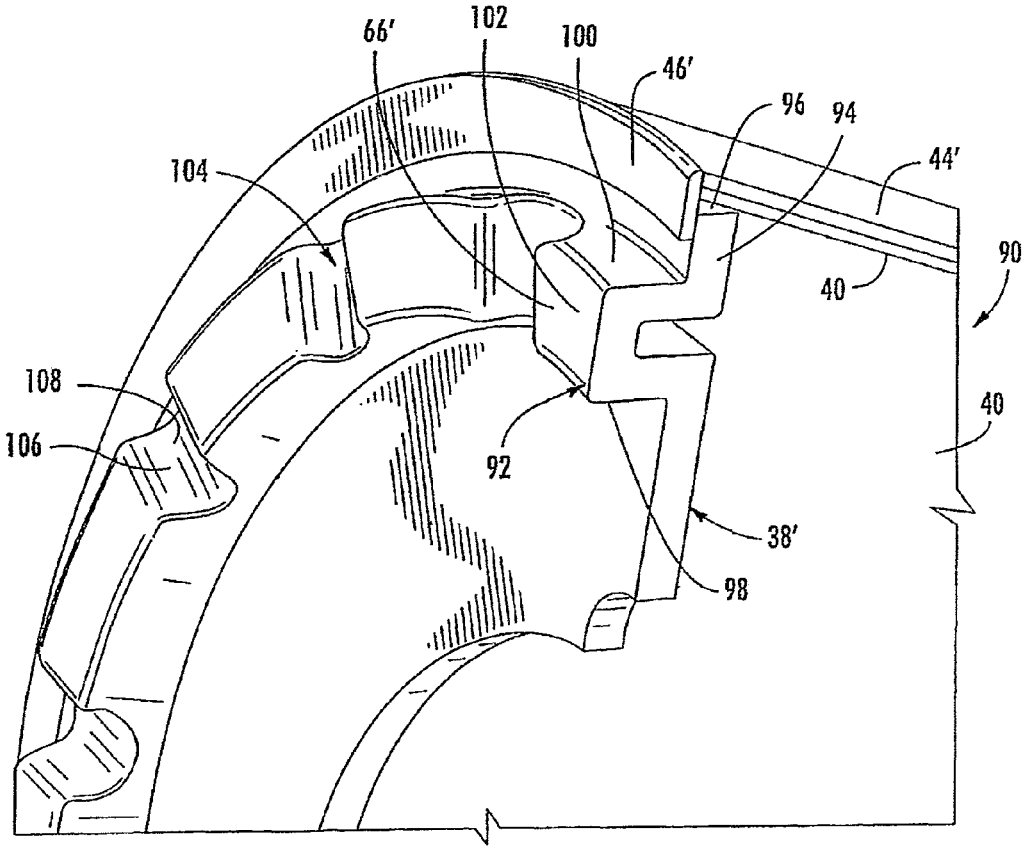
FIG. 18 is an enlarged detail perspective view, partially in cross-section, of the cylinder guard of the present invention taken along line 18-18 of FIG. 17.

Although an embodiment of the cylinder guard 50 has been described as being formed of a single piece of steel, principles of the present invention may also be applied to a multi-piece guard. For example, the multi-piece conventional guard 36 with thin cover 44 can be made more robust in withstanding a typical attack by equipping the guard 36 with an axial and vertical flange, as can be seen in FIGS. 17 and 18. Here, in the embodiment shown, a multi-piece steel guard 90 using principles according to the present invention includes a steel guard member 40, a significantly modified steel back plate 38' and a modified cover 44' connecting the steel back plate to the steel guard member.

In this embodiment, the steel back plate 38' is formed of a single piece of steel, which in some embodiments could be from 0.045 inches to 0.055 inches thick. Back plate 38' defines an axial flange portion 92 and a radial flange portion 94, located adjacent the outer circumferential rim 96 of the back plate. Referring to FIG. 18, the axial flange portion 92 is in turned defined by a radially-inner axial portion 98 together with a generally parallel radially-outer axial portion 100 joined by a radial portion 102. The radial portion 102 serves as an inner face portion 66' for the axial flange portion 92. A plurality of back plate stiffeners 104 are formed equidistantly circumferentially about the inner face portion 66'. In some cases, back plate stiffeners 104 are formed by radial indentations 106 having bottom surfaces 108 with generally arcuate cross-sections. The radial flange portion 94 extends radially outwardly from the axial flange portion 92 to engage the guard member 40. Back lip 46' of cover 44' extends radially inwardly to retain plate 38' against guard member 40. The back lip 46' of the cover 44' and the radial flange portion 94 cooperate to form a radial flange that abuts a door 16 upon installation of the deadbolt lock 10.

Thus, employing principles of the present invention, stiffeners 104 have increased the surface area of the axial flange portion 92, thereby increasing the moment of inertia in the region of the guard 90 against which an attack is usually directed, and thereby decreasing the chances that the deadbolt's security will be breached by repeated blows of such an attack.

A method for making a one-piece steel cylinder guard 50 according to an embodiment of the present invention is illustrated in FIGS. 19A-19E, which schematically depict the side views of the guard during an important portion of the progression of stamping performed by a multi-station tool. In some embodiments, a 200-ton punch press is used to punch the parts out of ASTM 1008 DS or DDS deep drawing steel strip have a thickness of from 0.055 inches to 0.066 inches.

Figure 19B:
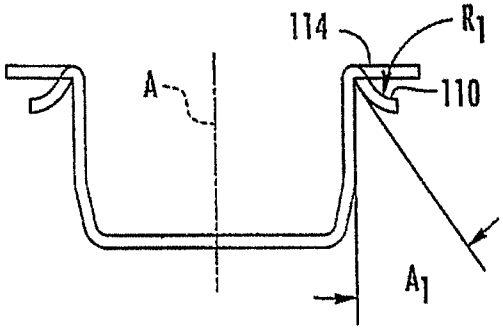
FIGS. 19A through 19E are schematic views of various steps in a method according to according to an embodiment of the present invention of making a cylinder guard for a deadbolt lock of the present invention.
Figure 19A:
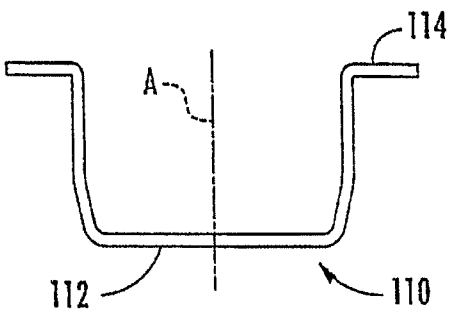
Figure 19E:
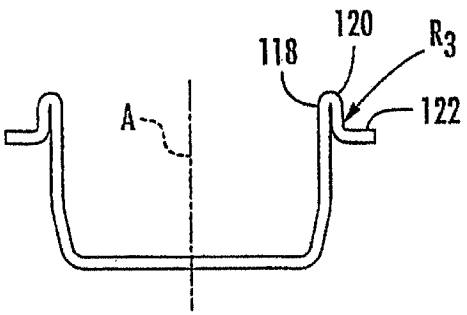
Figure 19D:
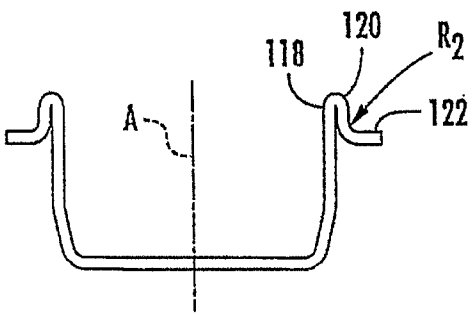
Figure 19C:
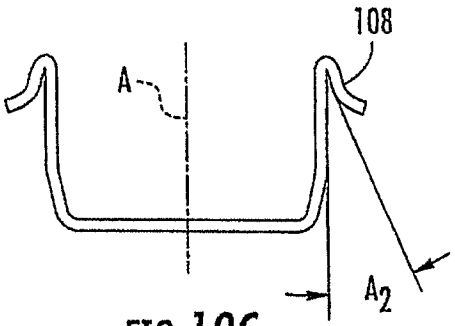

As shown in FIGS. 19A-19E, a cup-shaped body 110 is initially formed and maintained throughout most of the process. A generally cylindrical body open at both ends is formed towards the end of the process when a bottom portion 112 of the body is removed. FIG. 19A shows the cup-shaped body 110 having been formed with a radial flange 114 at substantially right angles to the cup-shaped body. In FIG. 19B, the flange 114 has been simultaneously bent axially rearwardly to a predetermined angle $A_1$ and formed with a curved portion 116 at the end of the flange 114, the curved portion having a predetermined radius $R_1$. In FIG. 19C, the flange 114 has been axially bent still farther to a predetermined angle $A^2$ less than $A_1$. FIG. 19D shows that the flange 114 has now been bent axially rearwardly to an extent that inner and outer generally parallel wall portions 118, 120, respectively, are formed, while simultaneously bending curved portion 116 so that the radially-outer end 122 thereof is substantially perpendicular to the axis A of the body 110, and so that the outer end 122 is joined to the outer wall portion 114 at a predetermined radius $R_2$, where $R_2$ is less than $R_1$. FIG. 19E illustrates the flange radius $R_3$ having been reduced to the desired finished radius of 0.030 inches.

Therefore, the one-piece steel cylinder guard 50 and the method for making it according to an embodiment of the present invention have provided robust protection against attack upon a deadbolt lock, at considerable savings in material cost and manufacturing time over conventional cylinder guards.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

The invention claimed is:

1. A cylinder guard for a deadbolt lock, the cylinder guard comprising:

a single-piece body defining a generally cylindrical wall having a predetermined thickness and a longitudinal axis;

wherein the cylindrical wall of the single-piece body includes a face portion and an inner portion;

wherein the face portion has a face end located at a forward opening of the single-piece body;

wherein the inner portion of the single-piece body extends axially rearwardly from the face portion to a first terminus;

wherein the wall of the single-piece body includes a portion extending radially outwardly between the face portion and the first terminus; and wherein the wall further includes a crush zone intermediate the first terminus and the face portion wherein the crush zone of the single-piece body is formed of one of deep drawing steel and drawing steel.

2. The cylinder guard of claim 1, wherein the face portion of the single-piece body defines a radially inwardly-extending lip, wherein the crush zone includes a blow-deflecting portion intermediate the inner portion and the lip, and wherein the blow-deflecting portion of the wall includes a generally conical portion tapering axially rearwardly and radially inwardly to the lip.

3. The cylinder guard of claim 2, wherein the crush zone includes a plurality of through-slots formed at least partially in the conical portion.

4. The cylinder guard of claim 1, wherein the first terminus defines an end surface and the cylinder guard further comprises a plurality of stiffeners formed in the end surface.

5. The cylinder guard of claim 4, wherein the stiffeners are defined by radially-extending indentations disposed circumferentially approximately equidistantly upon the end surface.

6. The cylinder guard of claim 5, wherein the stiffeners are defined by circumferentially extending indentations disposed circumferentially approximately equidistantly upon the end surface.

7. The cylinder guard of claim 1, wherein the wall is formed of a single piece of steel.

8. A cylinder guard for a deadbolt lock, the cylinder guard comprising:

a single-piece body;

an inner portion and a face portion of the single-piece body defining a longitudinal axis;

wherein the face portion has a face end located at a forward opening of the single-piece body;

the inner portion including a radially-extending portion and an axial flange disposed wherein the axial flange defines an inner face portion;

wherein the axial flange is located opposite the face end located at the forward opening of the single-piece body;

a plurality of stiffeners disposed upon the inner face portion of the single-piece body;

wherein the plurality of stiffeners increases the moment of inertia of the axial flange to enhance the resistance of the cylinder guard to a generally radially-directed blow upon the deadbolt lock; and wherein the inner portion is a unitary piece of steel.

9. The cylinder guard of claim 8, wherein the plurality of stiffeners are defined by a plurality of radial indentations formed upon the inner face portion.

10. The cylinder guard of claim 9, wherein the plurality of radial indentations is approximately equally circumferentially-spaced about the inner face portions.

11. The cylinder guard of claim 9, wherein the axial flange is defined by a wall having a radially-inner portion and a generally parallel radially-outer portion joined by a radial portion, and wherein the axial flange inner face portion is formed on the radial portion of the wall.

12. The cylinder guard of claim 9, wherein the face portion defines a radially-inward forward lip; and further comprising a cover connecting the inner portion to the face portion, wherein the cover defining an inner lip and a face lip, and wherein the face lip engaging the forward lip of the face portion.

13. The cylinder guard of claim 12, wherein a single piece of steel defines the inner portion and the face portion.

14. The cylinder guard of claim 13, wherein the face portion defines a radially-inward lip, and further comprising a blow-deflecting portion disposed intermediate the radial flange and the radially-inward lip, wherein the blow-deflecting portion includes a conical portion tapering radially inwardly to the radial-inward lip.

15. A method of making a cylinder guard, the method comprising the steps of:

providing a unitary piece of steel;

forming the unitary piece of steel into a cup-shaped single-piece body to define a cylinder guard formed from a single, unitary piece of steel;

wherein the cylinder guard includes: wherein the cup-shaped single-piece body defining a generally cylindrical wall having a predetermined thickness and a longitudinal axis; the cylindrical wall including a face portion and an inner portion; wherein the face portion has a face end located at a forward opening of the body; the inner portion extending axially rearwardly from the face portion to a first terminus; the wall including a portion extending radially outwardly between the face portion and the first terminus and wherein the first terminus is located opposite the face end located at the forward opening of the cup-shaped single-piece body.

16. The method of claim 15, wherein the forming step includes stamping the piece of steel.

17. The method of claim 16, wherein the forming step includes forming a radially-extending position on the body of the cylinder guard.

* * * * *